United States Patent [19]

Grotnes

[11] 4,004,529

[45] Jan. 25, 1977

[54] CAN HEAD SEAMING METHOD AND APPARATUS

[75] Inventor: Eugene R. Grotnes, Atlanta, Ga.

[73] Assignee: Atlanta Grotnes Machine Company, Atlanta, Ga.

[22] Filed: July 14, 1975

[21] Appl. No.: 595,673

[52] U.S. Cl. ..... 113/58; 72/29; 113/1 E; 113/19; 113/23 E; 113/30; 113/121 C

[51] Int. Cl.[2] ..... B21D 39/02

[58] Field of Search ..... 72/29; 113/30, 58, 120 K, 113/121 R, 121 A, 121 C, 1 E, 19, 22, 20 A, 21, 23 R, 23 C, 23 D, 23 F, 23 E

[56] References Cited

UNITED STATES PATENTS

| | | | |
|---|---|---|---|
| 923,688 | 6/1909 | Nelson et al. | 113/21 X |
| 1,047,666 | 12/1912 | Leffler | 113/21 |
| 1,167,347 | 1/1916 | Brenzinger | 113/21 |
| 1,486,974 | 3/1924 | Lindgren | 113/23 E |
| 2,779,301 | 1/1957 | Grotnes | 113/23 R |
| 3,672,317 | 6/1972 | Halling et al. | 113/1 E |

*Primary Examiner*—Victor A. DiPalma
*Attorney, Agent, or Firm*—Patrick F. Henry

[57] ABSTRACT

A cylindrical metal barrel is joined to the heads or closures on opposite ends by the bending together of the annular material of the head and respective barrel end to form the usual double seam made by seamer rolls brought to engagement by means of cams. The metal barrels are supported between movable heads on which are mounted respective barrel chucks driven by respective and individual chuck spindles driven from a respective motor and clutch drive on each head. A power take-off operates a common drive shaft between the heads which has the actuating cams thereon that vertically move the seaming rolls. Thus, there is independent operation at each end of the barrel on each head for making each respective double seam.

26 Claims, 11 Drawing Figures

CAN HEAD SEAMING METHOD AND APPARATUS

BACKGROUND OF THE INVENTION

1. Field of the Invention

Metal working, especially machines for applying metal barrel heads to metal barrels.

2. Description of the Prior Art

The seaming of barrel heads on metal barrels is well known and a typical machine is disclosed at least as early as U.S. Pat. No. 1,486,974 issued to Lindgren on Mar. 18, 1924. The procedure for bending the metal around the periphery of a metal barrel and forming a double seam from cam operated seamer rolls brought into engagement with the material is well known and is discussed in numerous publications and patents including "EVALUATING A DOUBLE SEAM", a bulletin distributed by Dewey and Almy Chemical Division, W. R. Grace and Company, Cambridge, Mass. Of course, cans and barrels vary as to the size and material and the forming of the seams vary accordingly. However, the procedure insofar as the making of the double seam is concerned is basically disclosed in the Lindgren patent. In the Lindgren machine and known prior art machines the chuck ring which supports the cover and barrel during the seaming operation on both ends of the barrel are driven from a common drive shaft in a substantially rigid mechanical drive arrangement. This arrangement of direct mechanical drive does not permit any differential between chucks and requires that the chuck rings be driven substantially at the same speed and at the same time which has been believed to be a criteria for a proper operating machine. These prior machines provide a normal speed of the chucks at approximately 180 to 240 r.p.m. If any appreciable differential in speed develops due to mechanical wear a seaming problem may develop. Any higher speeds produce excess load on the clutch and brake and the gear noise is too high. In fact, older machines in present day use are so noisy as to be unacceptable by certain noise standards promulgated according to Government regulations. Also, the controls for the machine were basically all mechanical and were limited as compared with electrical or hydraulic-electrical control combinations. The independent drive arrangement of the present machine makes it possible to increase the speed without increasing the noise and to bring the overall noise of the machine down to a lower level. In addition, the present method of roll forming the double seam through independent drive on each chuck eliminates any problem previously caused by the dependent straight drive mechanical relationship between the roll forming on opposite ends. Furthermore, in some instances of seaming only one chuck need be driven and the other one can be idling or a slave which is caused to seam movement of the drum.

SUMMARY OF THE INVENTION

The present invention pertains to a method of double seaming barrels and respective heads by means of independently driving the chuck supported head and barrel on each end during the double seaming from the seamer roll.

The present invention is further characterized in that although the seaming of the barrel and head is essentially and basically the same seam as performed by other methods and apparatus, and therefore adheres to any and all previous standards, the machine employs independently driven chucks on opposite sides of the barrel making possible the use of a motor and clutch drive arrangement rather than straight mechanical drive.

Therefore, an object of this invention is found in the means for supporting the barrel for subsequent positioning in the chuck and also in the adjustment and alignment means for adjusting the chucks by adjusting the heads on which the chucks are mounted through a motor drive.

Other and further objects and advantages of this invention will become apparent upon reading the following description of a preferred embodiment taken in conjunction with the accompanying drawings.

DESCRIPTION OF A PREFERRED EMBODIMENT

It should be understood at the outset that the seaming per se as performed on the metal of the drum and each respective head or closure is not changed essentially or noticeably by the present machine since it is desirable to adhere to conventional standards and to effect conventional seaming. Therefore the operation of the roll spindle and seaming rolls is not new per se and is found in the prior art including certain prior art patents such as the aforementioned U.S. Pat. No. 1,486,974. According to conventional double seaming operations the drum and closures are placed on chucks which are rotated against seaming rolls brought into engagement therewith.

Figure 1:
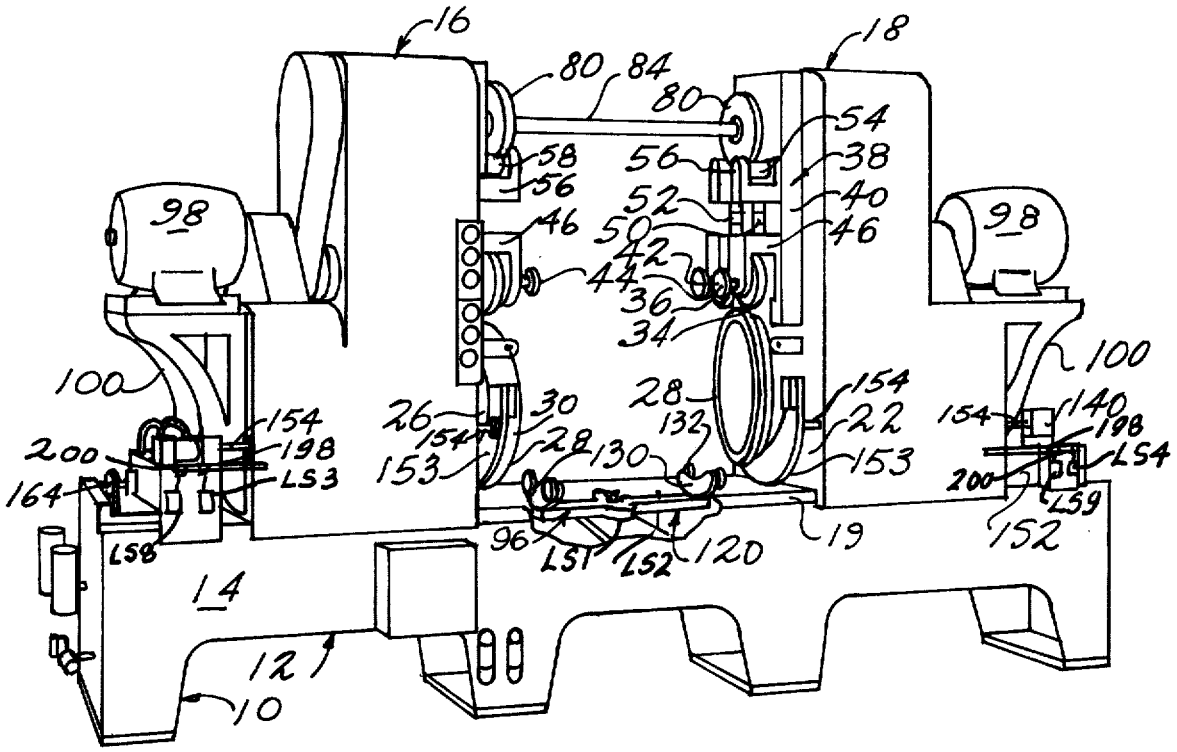
FIG. 1 is a perspective view of the present seaming machine.
Figure 2:
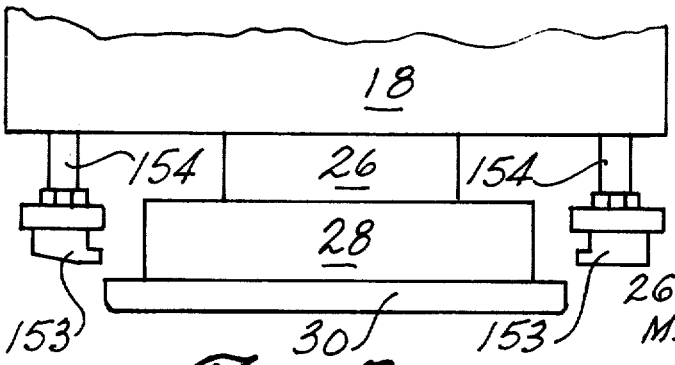
FIG. 2 is a top plan view looking down on the chuck and seamer rolls.
Figure 11:
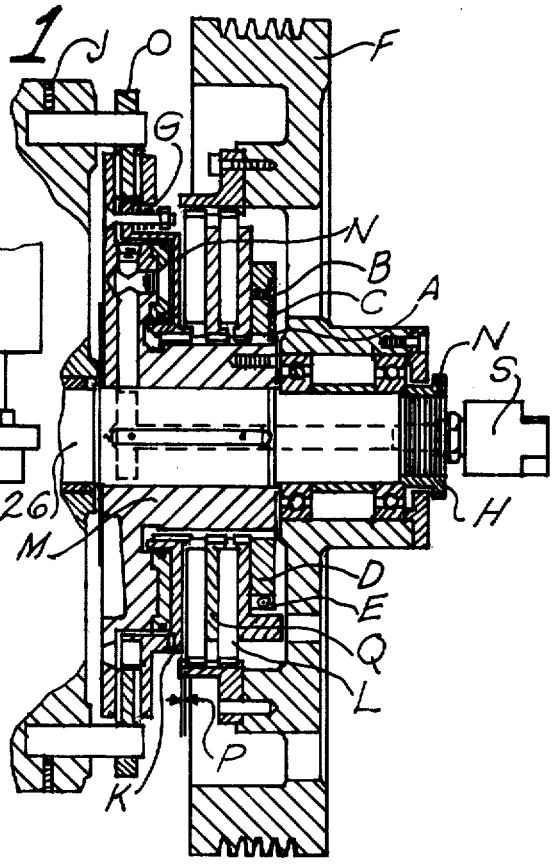
FIG. 11 is a cross-sections view of the conventional clutch and brake assembly for each head and which drives each chuck.

In FIG. 1 the overall machine 10 comprises a bed frame or base 12 of heavy steel construction and comprising a frame covered by heavy steel plate 14. A pair of vertically disposed, horizontally slidable seaming heads 16, 18 mounted for sliding on base 12 on opposed rails 19 are respective left and right hand heads constructed substantially identical for performing a double seaming operation on the opposite ends of a drum. Each head 16, 18 comprises a housing constructed from various frame members 20, 22, 24 supporting a substantially horizontal chuck spindle or shaft 26 which is connected by means of a combination multiple disc friction clutch-brake 27 of the sort manufactured by Minster Machine Company, Minster, Ohio 45865, and sold under the trademark "MINSTER". The entire clutch-brake unit 27 is assembled on a one-piece clutch sleeve which is pressed and keyed on the shaft 26. The clutch may have single or multiple drive discs L, depending upon torque requirements, and may be coupled to the flywheel F as shown or adapted to a geared type drive. Air pressure applied to the clutch, through an electrically controlled solenoid air valve, results in two immediate actions: the brake is released and the clutch is engaged. Exhausting the air results in opposite actions: the clutch is released and brake applied. Since both actions occur rapidly and simultaneously, controlled movement of the shaft 26 is achieved by controls. In the operations of the clutch-brake 27, air, controlled by the solenoid operated air valves, flows through the shaft by way of a rotary air distributor mounted on the shaft end. Diagonally opposite air passages in the clutch sleeve are aligned with an air passage cross-ported through the shaft. Air coming through the shaft is then dissected through the clutch sleeve ports and into the pressure chamber formed by pressure plate. As air pressure builds up behind the pressure plate and overcomes the brake spring pressure, the pressure plate moves laterally to press the moving molded drive discs and motionless case driven discs together thereby transmitting drive motion from the flywheel, or gear, to the machine shaft 26. While clutch is engaged, brake discs O floats on the brake anchor pins. When the air is exhausted from the pressure plates chamber, 12 brake springs automatically clamp the anchored stationary brake disc between pressure plate N and clutch sleeve M thus stopping shaft rotation. The brake torque is constant and is maintained by predetermined compression of the brake springs with the brake spring boots.

Heads 16, 18 are slidable on rails 19 horizontally towards or away from each other in order to chuck a drum in position.

Spindle 26 supports a conventional circular chuck 28 having a flanged chuck ring 30 on which is positioned a removable drum with lid or drum head. A pair of conventional seaming rolls 34, 36 on each seaming head 16, 18 are mounted for vertical sliding movement substantially side-by-side in a slide frame 38 comprising vertical slide frame members 40, 41 on opposite sides in which are mounted respective roll spindles, 42, 44 mounted in roll spindle caps 46, 48 having respective roll adjusting screws 50, 52 therein which are attached to respective cam follower slides 54, 56 supporting respective cam followers 58, 60 mounted on respective cam follower shafts 62, 64 which are attached on the back side inside the housing to a spring guide 66 comprising a spring guide block 68, 70 having a coil spring 71, 72 respectively mounted thereon. The seaming rolls 34, 36 on each seaming head, 16, 18 are moved into engagement first with one seaming roll 34 of a certain contour moved into engagement with the projecting material of the head or lid to bend same around the projecting material of the drum and then the other seaming roll 36 is brought into engagement immediately thereafter to complete the flattening and doubling of the same in a manner which is conventional and ordinary in this art and does not per se constitute a novel part of this invention. This operation and procedure as well as the performance of similar cams is shown in the aforementioned Lindgren U.S. Pat. No. 1,486,974 and is found in many existing prior art machines. The coil springs 71, 72 are held by a block 74 fastened to the head frame member 22 and there is a respective slot 76 in which each respective shaft 62, 64 will operate a limited distance.

Figure 3:
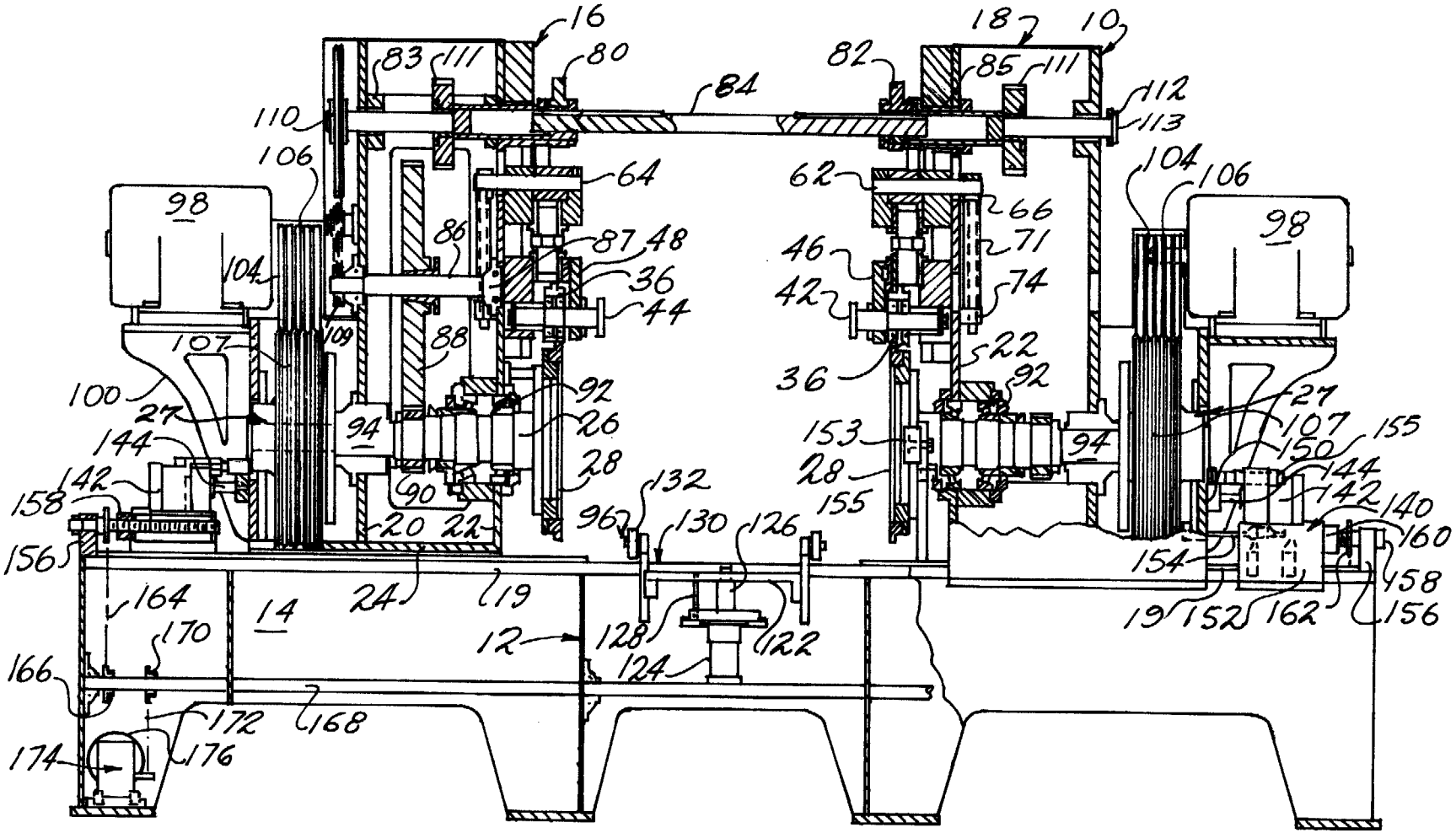
FIG. 3 is a cross-sectional view taken substantially medially vertically through the machine shown in FIG. 1.
Figure 5:
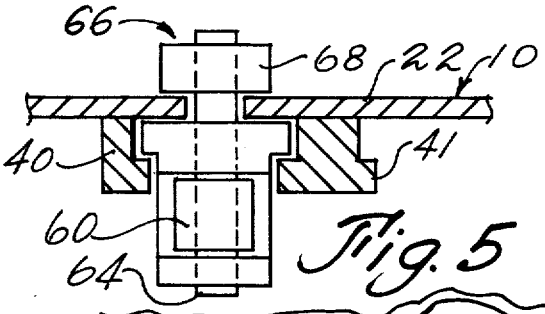
FIG. 5 is a cross-sectional view taken substantially along lines 5—5 in FIG. 4.
Figure 6:
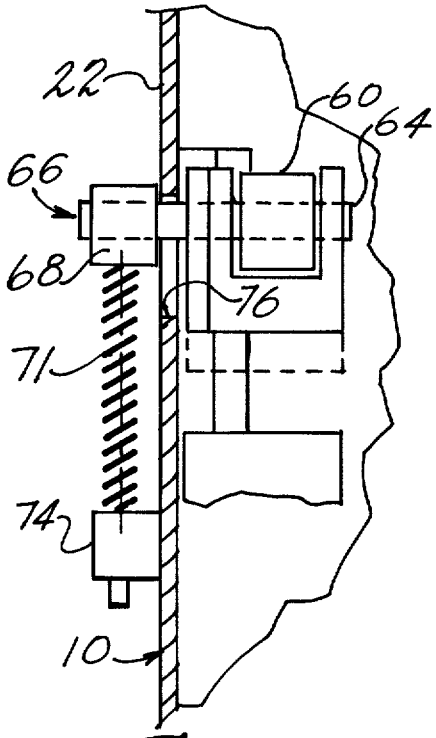
FIG. 6 is a cross-sectional view taken substantially along lines 6—6 in FIG. 4.
Figure 4:
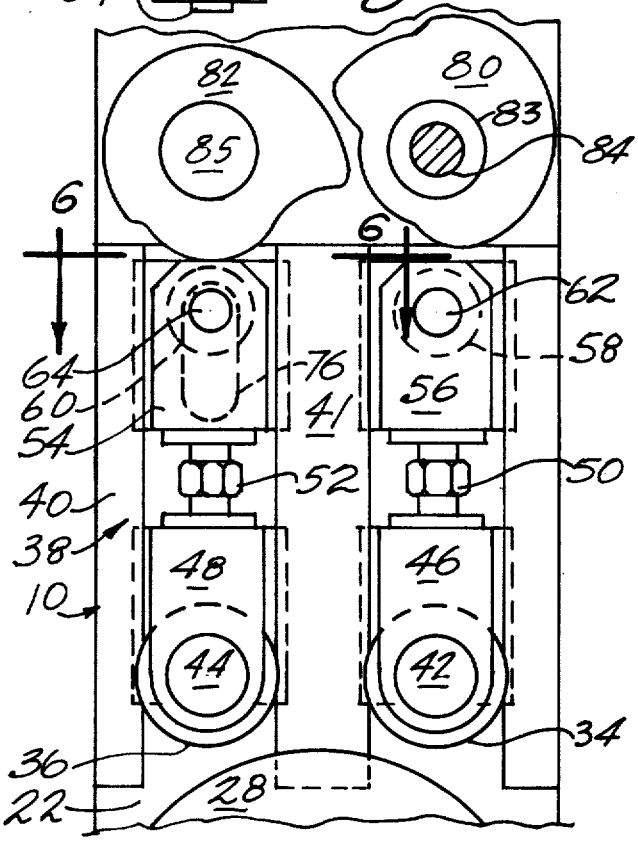
FIG. 4 is an enlarged front elevation view of the cam and seaming rolls in maximum up position.
Figure 7:
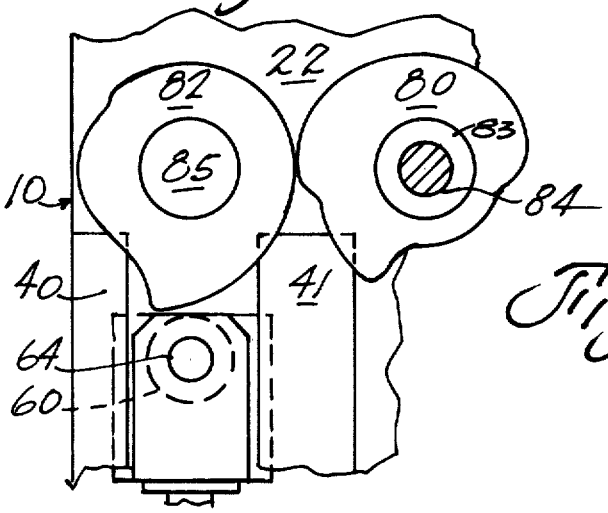
FIG. 7 is an enlarged front elevation view similar to FIG. 4 but with the seaming roll in maximum down position.

The respective seaming rolls 34, 36 on each seaming head 16, 18 are driven from a short hollow-ended shaft 83 supported on head 16 (there is a similar shaft 83' on head 18) by means of respective seaming roll drive cams 80, 82 mounted on respective cam shafts 84, 85 as readily seen in FIGS. 3 and 4.

A jack shaft 86 extending from suitable bearing support 87 on frame member 22 through a rear frame member 22 on the respective heads 16, 18 has a large drive gear 88 thereon which is driven by a smaller gear 90 mounted on each respective spindle shaft 26. As mentioned previously, the spindle shafts 26 on each of the heads 16, 18 are supported in suitable bearing support means 92, 94 and are driven through the Minster, or similar, clutch brake arrangement 27 which is operated from an air line through a pneumatic control means which actuates the clutch drive in sequence to drive the chuck 28 after the drum has been properly cradles and seated on the chucks 28. The chuck cradle is designated generally by reference numeral 96 and will be discussed later.

A motor 98 on each head 16, 18 is supported by means of motor support 100 suitably attached to each respective head 16, 18 and has a motor drive pulley 104 thereon driving a plurality of belts 106 which engage a large drive wheel 107 mounted on the spindles 26 turning gear 90 which engages the gear 88. A drive sprocket 109 on jack shaft 86 drives a chain turning shaft 83 which has a hollow end slidably receiving and driving therein the cam shaft 84 (there is a similar shaft 83' on the other head 18 driving a gear 111 which drives a gear 112 to operate the respective cams 80, 82). Shaft 84 has a gear 111 in head 16 driving a gear 112 next thereto in head 16 thereby driving cam shaft 85. Shaft 84 extends across and between both heads 16, 18 and is keyed to shafts 83, 83' to slide therein as heads 16, 18 close on each other and separate while continuing to drive. Cam shafts 84, 85 have the respective cams 80, 82 thereon. Thus, the jack shaft 86 drives the elongated drive shaft 84 to operate the respective cams 80 on each of the heads 16, 18 which in proper sequence brings the respective seaming rolls 42, 44 into sequential engagement against the projecting lip and material of the drum head and drum on each end. Once the clutch is engaged the cams 80, 82 start to operate to drive the respective cam rolls 58, 60 against the springs 71 and as shown in FIG. 4 the right hand cam 80 precedes the other cam so that the operation is to engage the seaming roll 34 which by means of the spring action 71 moves vertically upward to initial position and the second cam 82 on each head 16, 18 then moves into position to complete the double seam and thereafter returns by means of the spring 71 vertically upwardly to initial position whereupon the clutch is disengaged and the respective head 16, 18 will retract horizontally outwardly to release the drum from the cradle. Shafts 84, 85 have limit switch cams 112, 113 on the head 18.

The drum cradle and support means is designated generally by reference numeral 120 and comprises a horizontal base plate 122 mounted on the frame 12 and vertically movably supported thereon by means of a hydraulic or penumatic cylinder device 124 having a vertically movable piston rod 126 therein and being provided with a guide rod 128 which extends vertically upwardly to the horizontal base plate 122. The cradle comprises a pair of opposed, arcuate cradle arms 130 each having a pair of rubber rollers 132 thereon and the respective arms 130 are contoured to accommodate the curvature of a barrel or drum manually placed and supported thereon for receiving the drum head or lid or which may be fed thereon by means of a conveyor system and arrangement not shown. Accordingly, a drum or barrel placed on the cradle 120 is substantially in horizontal alignment thereon for chucking onto the chuck 26 and the hydraulic cylinder 124 is operated sequentially by means of the electrical relay system to bring the drum into proper alignment and engagement with the chuck rings 30. Of course, a drum can be chucked (positioned on chuck 28) entirely by hand and the heads 16, 18 closed manually by select operation of switches.

The respective heads 16, 18 are brought into engagement with the barrel to position the open ends of the barrel closure or head in and on the chuck ring 30 by means of respective head closing means, sometimes referred to as a stripping operation or stripping means, comprising a support base 140 mounted on base frame 12 on each end thereof outside of each respective head 16, 18 and having a hydraulic or pneumatic piston and cylinder arrangement 142 of the sort which is manufactured by Tomkins Johnson or any other manufacturer, having a short stroke piston rod 144 therein which is connected to the respective heads 16, 18 at one end thereof by means of an attachment device and adapter 150 which attaches the piston rod 144 to the frame member 22 on the respective housing 16, 18 in order to provide a means for quickly moving each head 16, 18 horizontally inwardly toward each other in order to chuck the drum and thereafter upon completion of the double seaming of the drum to quickly and rapidly move the respective heads 16, 18 away from each other on the bed frame 12 to disengage the chucks and release the drum on the cradle 120. The respective hydraulic cylinders 142 are operated from a hydraulic line sequentially according to the circuit and hydraulic schematic shown in FIGS. 8, 9 and 10 or of course each operation may be performed manually by actuating the respective switches and actuators.

The initial positioning of each chuck 28 may be significant insofar as the amount of closure and engagement between the respective chucks 28 and the respective drum heads so there is provided a means for accurately presetting the travel of each head 16, 18 and to govern the effect of the stroke of the piston rod 144 when actuated to move the respective head 16, 18. Each of the support bases 140 for the respective cylinders 142 is movably mounted on the base frame 12 on the rails 19 thereon by means of side support plates 152. The drums are stripped (removed) by means of arcuate strippers 153 stationarily mounted behind each chuck 28 on stripper rods 154 which extend thru each respective head 16, 18 and are mounted and anchored to the base 140 on each end of the frame. If the can or drum fails to dislodge after seaming, as the heads 16, 18 move outwardly each stripper 153, being in the way, contacts the drum on chuck 28 and knocks it off the chuck 28.

A housing adjusting screw bracket 156 mounted on the end of the machine frame has a housing adjusting screw 158 mounted therein and which extends horizontally into the adjusting screw block 160 attached to the base 120. The housing adjustment screw 158 is provided with a sprocket 162 which is driven through a chain 164 from a sprocket 166 mounted on an elongated adjusting drive shaft 168 extending horizontally through the inside of the bed frame or base 12. Shaft 168 is driven by means of a sprocket 170 which is driven from a chain 172 from a motor drive assembly 174 mounted in the base. The motor may be a "Reliance" (trademark) gear head motor operating at approximately 58 r.p.m. and having an output drive sprocket 176 thereon so that when the motor is energized manually or from the electric circuit in sequence, and normally this is done entirely manually visually to align the chuck in the closing operation, the adjusting screw is operated in one direction or the other to preset the position of each head 16, 18 thereby determining the amount and extent of closure each time the heads 16, 18 are closed on a drum. This is a presetting operation and a means of adjusting and predetermining the amount of closure in order to provide a proper chucking of the drum and to adjust for any changes which may take place by virtue of wear, drum variation or whatever.

Figure 8:
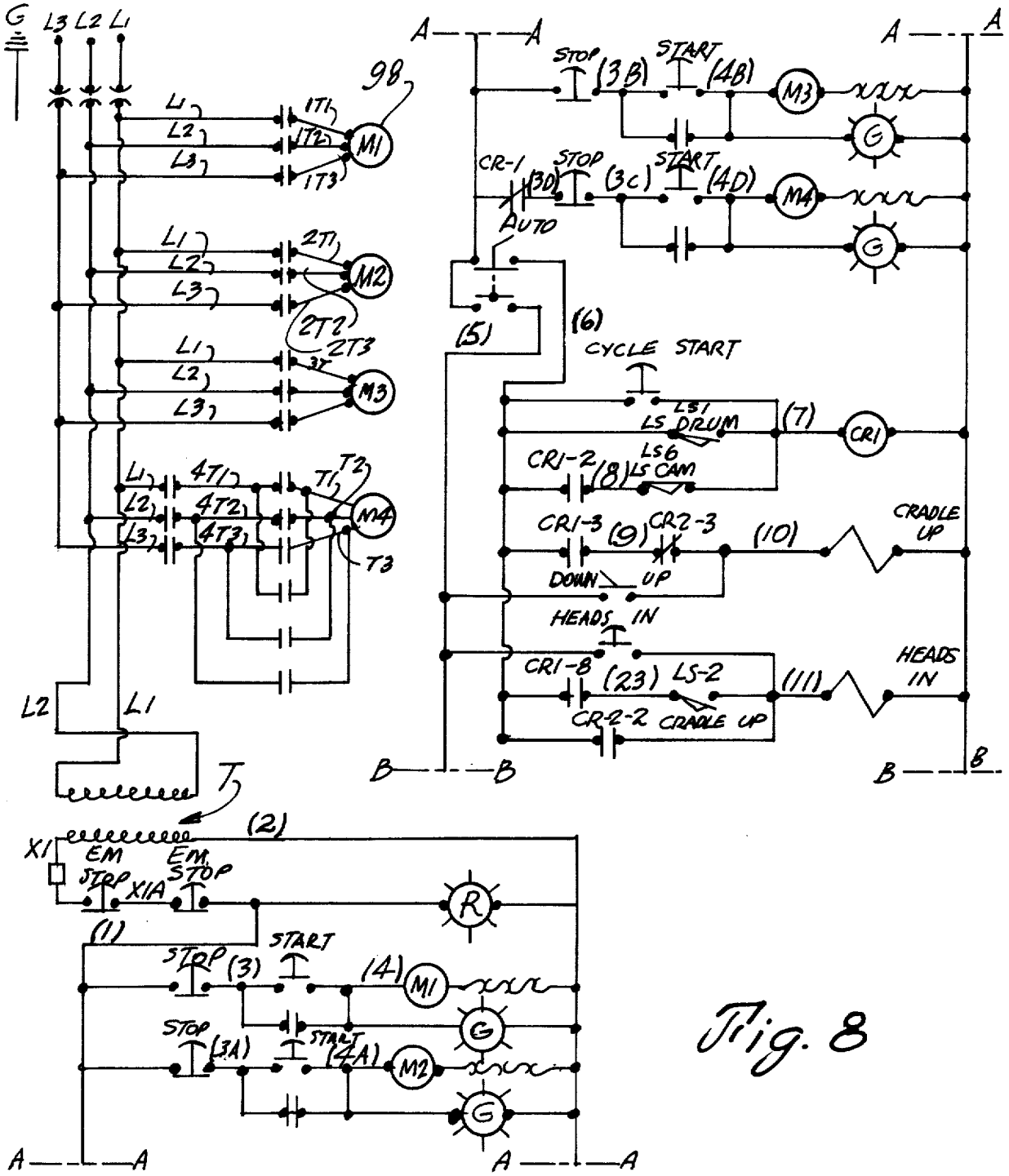
FIG. 8 is the first part of an electrical control diagram in which parts A—A are to be matched and connected.
Figure 9:
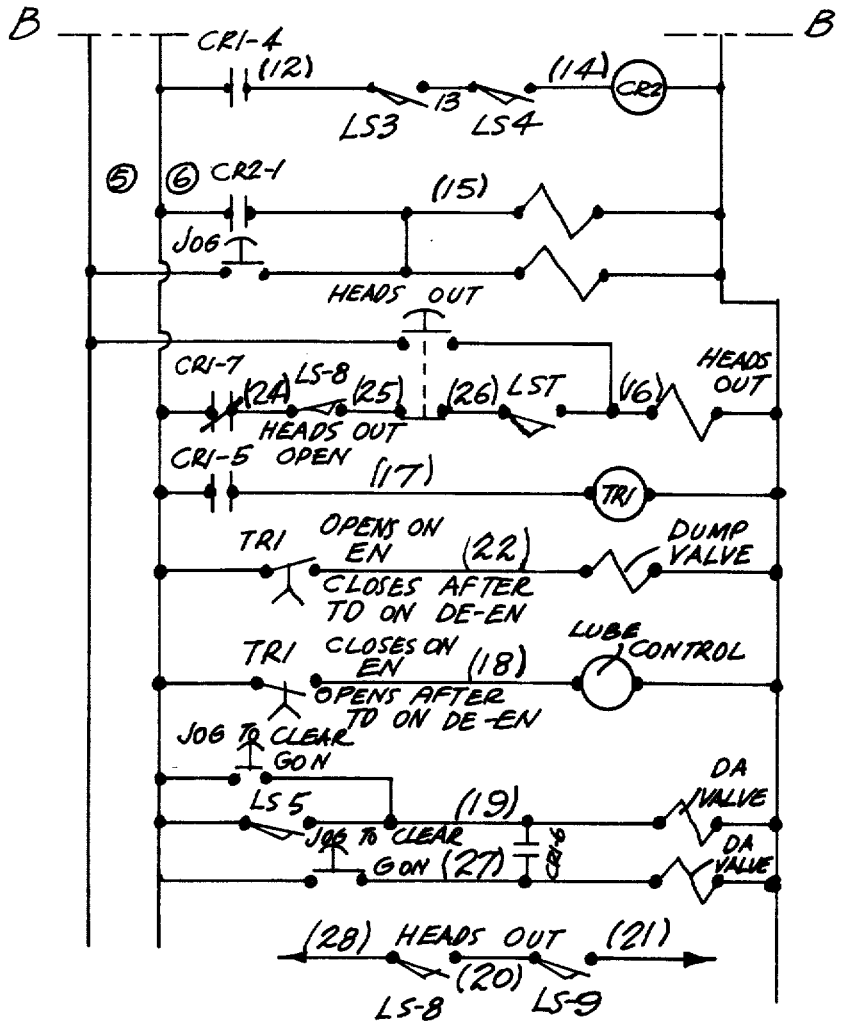
FIG. 9 is the remaining part of the circuit diagram of FIG. 8 and in which parts B—B match.

In the circuit diagram shown in FIGS. 8 and 9, the numbers in parentheses (1), (2), (3), (3)(A), etc. through (28) identify circuit wires used in the wiring of the machine and may be used to refer to those particular wires as well as that circuit.

The control circuit comprises three lines L1, L2, and L3 which have various branches leading to the respective head motors 98 also designated M1 and M2 for purposes of circuit diagrams since there are two such motors respectively each on the heads 16, 18. The connections to each motor M1, M2 are designated respectively as 1T1, 1T2, 1T3 and 2T1, 2T2 and 2T3. The M3 motor is the hydraulic motor which may be typically a 7.5 hp motor operating at 1750 r.p.m. and this motor is not shown in the drawings since it is located on a separate base together with a hydraulic pump (not shown) to supply the hydraulic pressure used in operating. A control circuit through a transformer T, which may be a 250 volt transformer, comprises indicated manual stop-start switches and contacts for operations of M1, M2 as well as visual lights R and G. There are relays and relay contacts designated CR-1, etc. with the respective contacts designated CR1-2, CR1-3, etc. Manually contacted limit switches designated LS-1, LS-2, etc. are located to be contacted as set forth below by the various mechanical parts of the machine during the sequence of operation. Once the sequence is started by pushing the "on" of the "on-off" button then the drum is automatically chucked, doubled seamed and released by the movement of each of the heads 16, 18 horizontally outwardly after having moved horizontally inwardly to close on the drum.

The sequence of operations of the circuit diagram is as follows:

1. Drum moves into center of base 12 on cradle 96 and trips LS1.
2. LS1 engages CR1 and CR1 is locked by contact CR1-2.
3. Contact CR1-3 closes and cradle 96 moves up to position drum.
4. When cradle 96 moves up LS2 is closed and heads 16, 18 move in to chuck the drum.
5. When heads are in position LS3 and LS4 are closed by head cam 198 and CR 2 is engaged.

6. Contact CR2-3 opens and cradle 96 drops down. Contact CR2-1 closes to engage the chuck clutches 108 to start the seaming cycle. Contact CR2-2 closes to hold heads 16, 18 in.
7. After seamer roll cams make one full revolution LS6 is tripped open by head cam 112.
8. Relay CR1 is de-energized. Contact CT1-4 de-energized relay CR2.
9. Contact CR2-1 opens to disengage the chuck clutches 108 and stop the seaming cycle.
10. LS7 is closed by cam 113 and heads 16, 18 move out and cam 200 trips limit switches LS8 and LS9.

Figure 10:
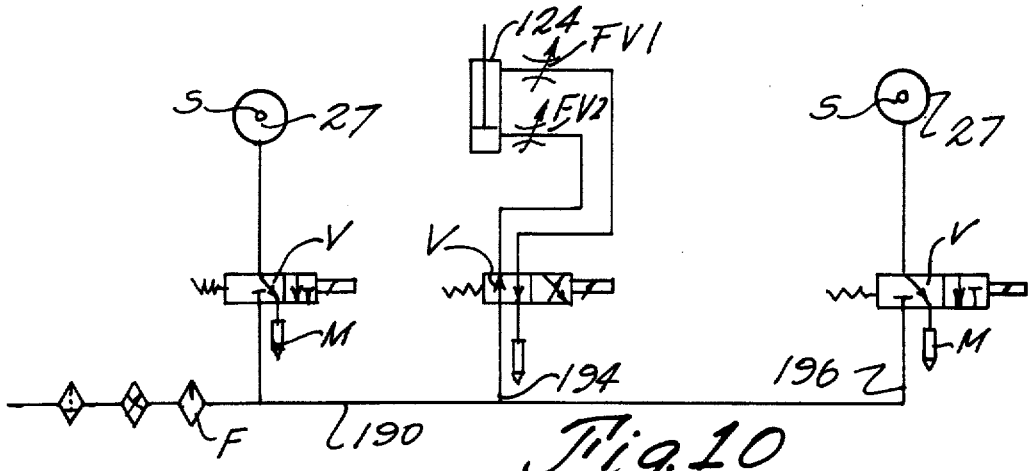
FIG. 10 is a hydraulic schematic diagram.
Figure 1:
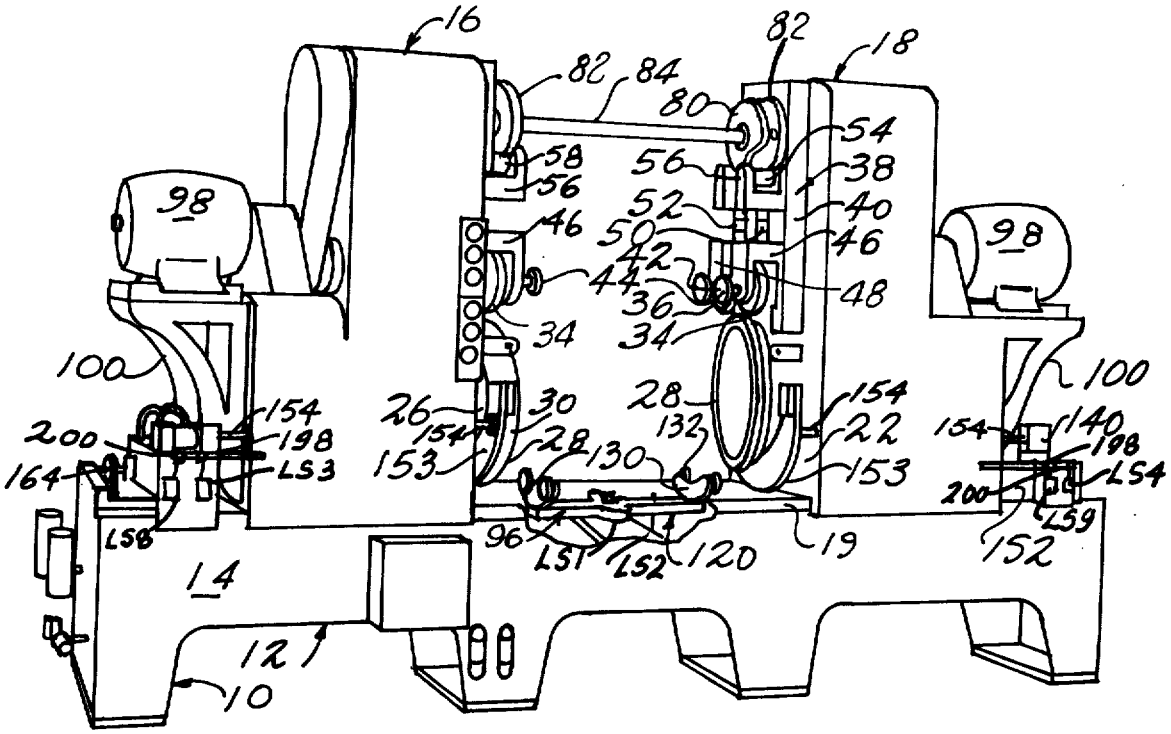
Figure 3:
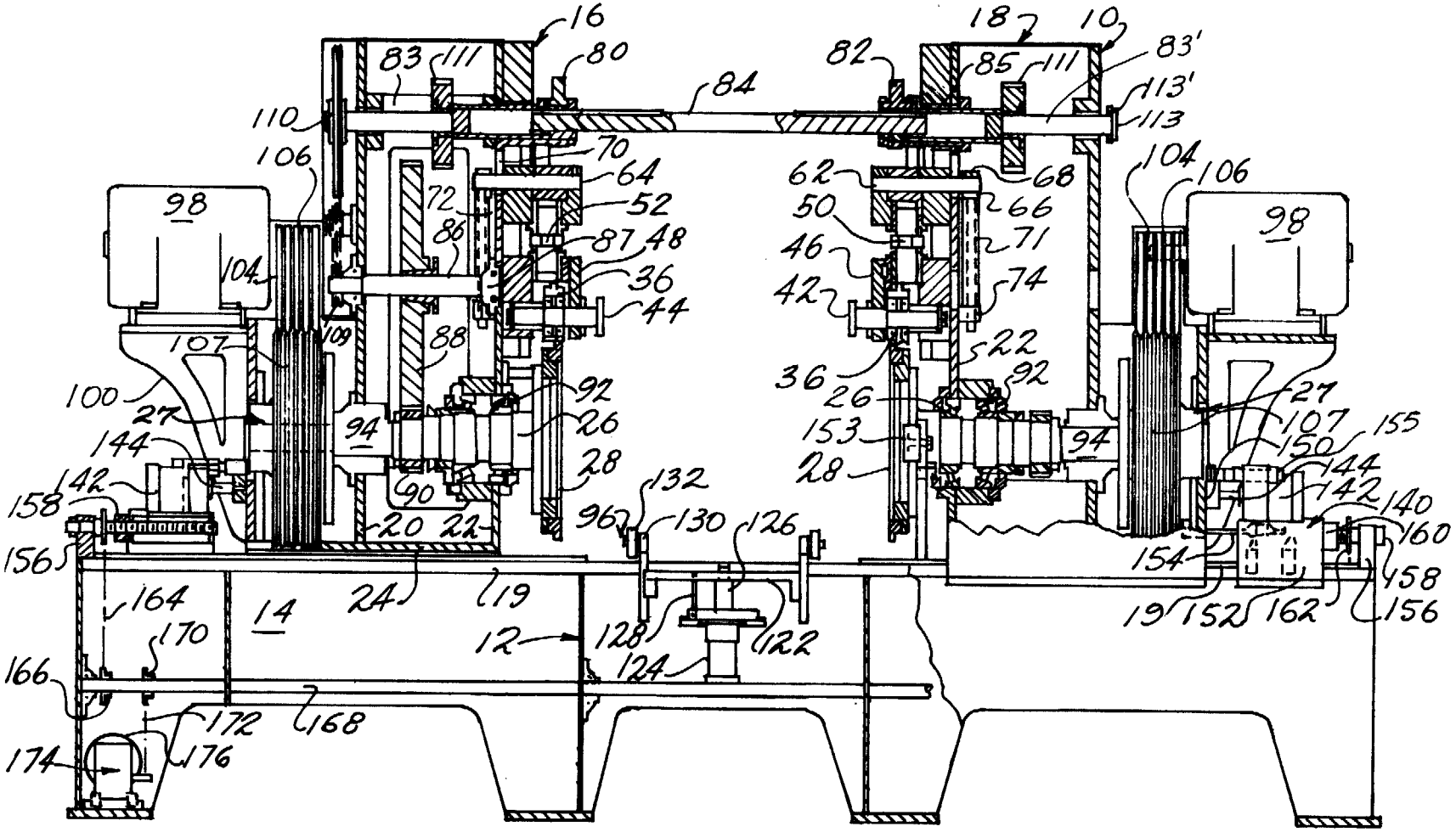
Figure 6:
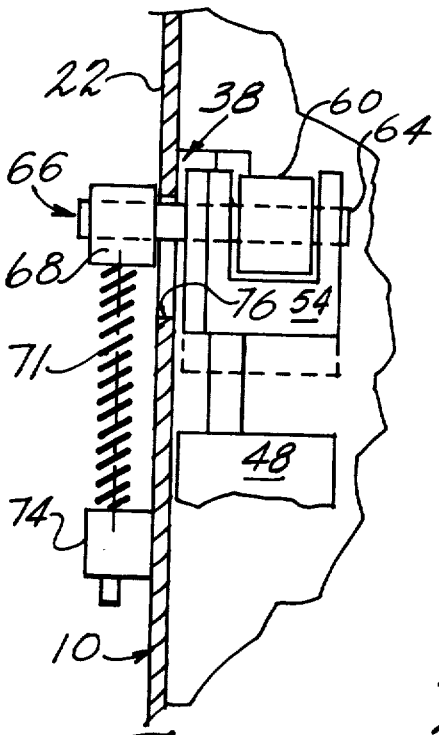
Figure 4:
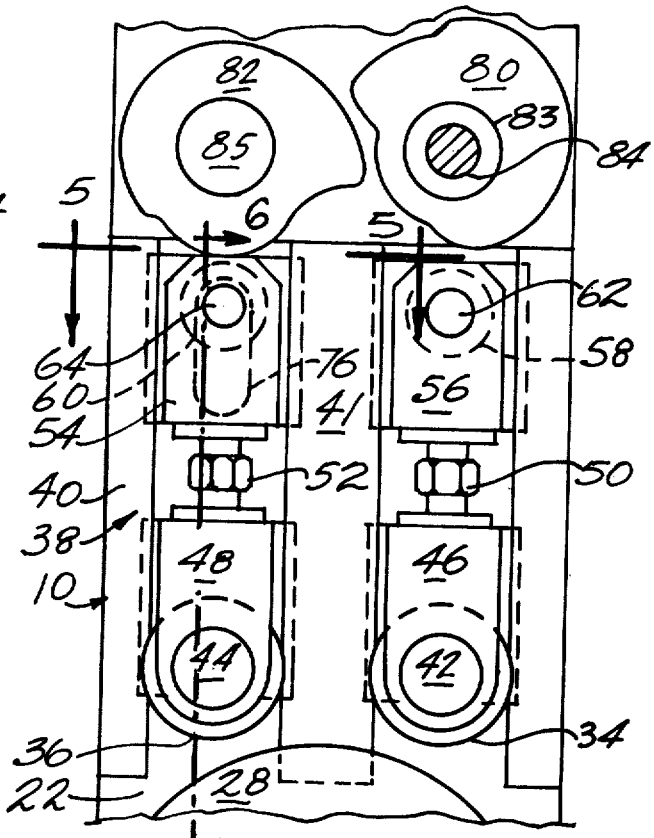
Figure 7:
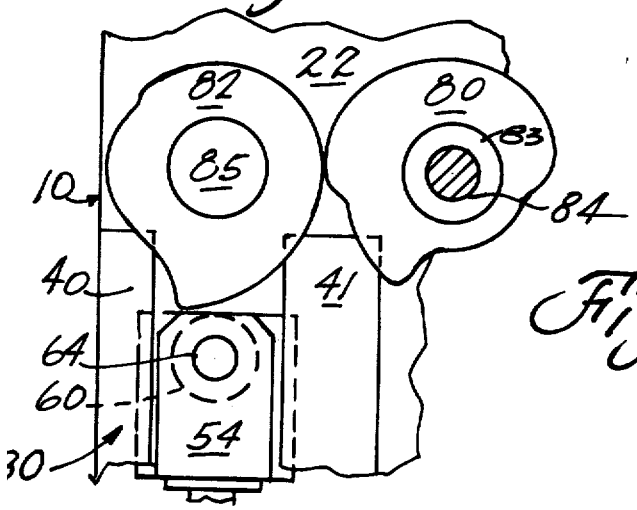
Figure 11:
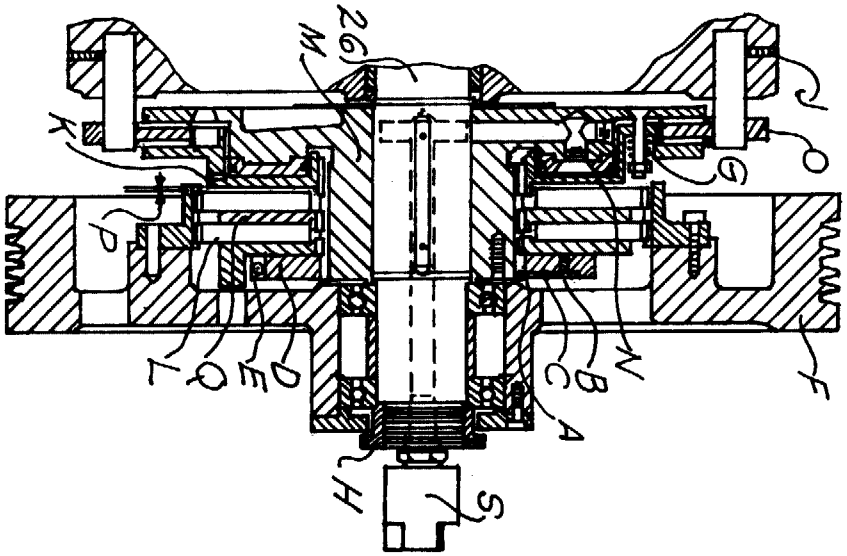

In the pneumatic schematic of FIG. 10, a pneumatic line designated generally by reference numeral 190 through suitable filtration and flow control devices F have branch lines 192, 194, 196 leading to the respective pneumatic elements. Line 192 and line 196 lead to the respective Minster (trademark) clutch brakes 27 through an electrically operated three-way valve V, which may be of the sort supplied from "Norgren", (trademark) and line 194 leads through a four-way valve V which may be of the sort manufactured by Norgren (trademark) to the cradle cylinder 124 which may be of the type supplied by Schrader. Each of the valves V is supplied with a muffler M. In addition, the four-way valve V is supplied with control valves FV1, FV2 so as to control the speed of the cradle cylinder 124.

It is therefore important to note that as contrasted with previous machines that the chucks 28 are related only during seaming when a drum is properly chucked and each of the spindles 94 and therefore each of the chucks 28 is driven independently of the other through the respective individual motors 98 and the individual clutches 27 whereby both chucks 28 are not driven from a common drive train or like arrangement but rather the chucks are connected during the seaming operation through the barrel whereas during the seaming operation each chuck 28 may initially start to turn independently of the other permitting some amount of differential of rotation between the two different chucks 28, but as soon as both chucks 28 are engaged, which is momentarily after closing on the barrel or drum, any differential is immediately adjusted thru the respective clutch brake 27 and there is syncronization of the chucks 28 upon the barrel during the seaming operation. It is possible to eliminate one chuck 28 drive so that it becomes a slave to the other and thereby drive from only one chuck 28 and motor 98, clutch 27, spindle 94, etc. thru the barrel.

While I have shown and described a particular embodiment of this invention together with a suggested mode of operation this is by way of illustration only since various changes, alterations, eliminations, deviations, revisions, additions and departures may be made from the embodiment shown without departing from the scope of the invention as defined only by a proper interpretation of the appended claims.

What is claimed:

1. In a seaming machine in which there is a base frame having a pair of seaming heads mounted in spaced relationship on said base frame for horizontal operation thereon toward or away from each other, a drum support means on said base and between said heads for supporting a drum and drum head thereon for a seaming operation, means on said frame for driving said heads to close on said respective ends of said drums, respective first and second chuck means on each of said heads for engaging a respective end of said drum and seaming means on said heads engageable with said drum for engaging thereagainst to form a seam between the drum and drum head, the improvement comprising: first and second respective independent drive means for driving a respective one of said respective chucks whereby the said respective first or second drive means drives only one respective chuck and whereby said first drive means is not connected to the second drive means until a drum is in place and then only thru the drum.

2. The device claimed in claim 1 wherein each of said drive means comprises a respective first and second motor operatively connected to said respective first or second chuck and a respective first and second clutch means for selectively engaging or disengaging said motor.

3. The device claimed in claim 2 including a respective means for braking each of said respective chucks when said respective clutch is disengaged.

4. The device in claim 3 wherein there is a respective means for operating each of said respective means for braking and said respective clutch means whereby the respective brake is released and the respective clutch is engaged and the respective brake is engaged and the respective clutch is released for seaming said drum.

5. The device in claim 2 including a power take-off means from said respective motor for driving said respective seaming means on each of said heads from said drive on only one head.

6. The device in claim 5 wherein said power take-off comprises an elongated driven shaft slidably mounted on and between both of said heads whereby said heads may open or close to drive said seaming means.

7. The device in claim 6 wherein there is a spindle for each chuck, a drive gear on said spindle engaged by said clutch, a jack shaft on one head, a driven gear on said jack shaft driven by said drive gear, and means for driving said elongated driven shaft from said drive gear.

8. The device in claim 6 wherein there are hollow shafts on each head in which said elongated shaft is supported, and one of said hollow shafts being driven by said motor from said clutch.

9. The device in claim 3 wherein said clutch means and said means for braking are a combination friction clutch and brake coupled to said chuck.

10. The device in claim 9, said combination friction clutch and brake having means for engaging and disengaging said clutch and brake by air pressure.

11. The device in claim 1, said drive means comprising a spindle, a drive gear on one of said spindles, a jack shaft on said head housing having a transfer gear thereon driven by said gear on said spindle.

12. The device in claim 5: a jack shaft, a drive means for driving said seaming means from said jack shaft on one of said heads, cam means on said drive means and on each of said heads and said cam means comprising a pair of cams, a pair of seaming rolls mounted on each of said heads, and there being other drive means between each of said cams and said seaming rolls to bring some into sequential engagement with the drum.

13. The device in claim 1: means engageable between said frame and each of said heads and including means for presetting same to adjust the extent of movement inwardly and outwardly thereby presetting the distance traveled against said drum, said means for presetting including a drive screw, a drive means for said screw and a motor for driving said drive means.

14. The device in claim 9: means on said frame engageable with said respective heads for moving same inwardly and outwardly and including a hydraulic cylinder and piston, means engageable between said frame and said hydraulic motor and piston on each of said heads for presetting same to adjust the extent of movement inwardly and outwardly thereby presetting the distance traveled against said drum, said means for adjusting including a drive screw, a drive means for said screw and a motor for driving said drive means.

15. In a seaming machine wherein there is a base frame, a pair of opposed seaming heads mounted for horizontal movement on said base frame toward and away from each other, a drum support mounted on said frame between said heads for supporting a drum with drum closure head thereon for seaming, seaming means operable on said heads for engaging a drum and closure for seaming same, each of said heads comprising a head housing having frame members thereon:

a seaming spindle supported on each of said heads and having a drum chuck connected thereto, said chucks being positionable in the respective, opposite ends of a drum for seaming on said machine, a drive means for said seaming means to bring same into sequential engagement with the drum between said heads, a motor on at least one of said heads, a clutch means mounted on said one of said heads and having a portion thereof driven by said motor and being connected to said spindle to rotate said chuck, brake means for braking said spindle, means for syncronizing said clutch and said brake means to engage said clutch and substantially simultaneously release said brake, and vice versa after seaming.

16. The device in claim 15: a drive gear on one of said spindles, a jack shaft on said one head housing having a drive gear thereon driven by said gear on said spindle, a drive shaft extending between said heads, and a drive means between said jack shaft on one of said heads and said drive shaft for driving said drive shaft to operate the seaming means on each head against each respective end of the drum.

17. The device in claim 16: a hollow shaft on each head having said drive shaft mounted therein.

18. The device in claim 15 wherein said clutch means and brake means are incorporated in a combination device connected to said spindle, said device comprising a part driven by said motor and selectively engaged by said clutch with said spindle, and a brake for said spindle operated substantially simultaneously with said clutch.

19. The device in claim 18 wherein said clutch and brake device include air pressure means for operating same by air pressure, there being a control means on said machine for actuating said air pressure means.

20. The device in claim 15: a motor for each of said heads and a clutch drive for said motor for each of said spindles on each respective head.

21. The device in claim 15: said spindle having the chuck thereon extending thru said one housing, said clutch being mounted on said head and connected to the end of said spindle, a rotatable housing on said clutch, an output member on said motor, means connecting said motor output member to said housing on said clutch to rotate same, and said brake being within said housing.

22. The device in claim 21: an air pressure actuator means on said clutch, solenoid means for actuating said air pressure means, and switch means contacted on said machine to operate said solenoid.

23. In a method for seaming a drum which comprises a cylindrical drum body having open ends which are provided with respective closures in the form of drum heads and which are engaged by seaming means to form seams to attach said drum heads to said drum: supporting said drum for rotation, engaging the opposite ends of said drum with respective support chucks, rotating at least one of said chucks from a drive means to drive said drum independently of said other chuck at least initially to adjust the speed of said drum on both chucks from the drive means.

24. The Method in claim 23: driving both of said chucks from separate and independent drive means, having means for adjusting and synchronizing the speed of both chucks thru said drum rather than by adjusting the speed of each chuck thru separate drive or from one common drive.

25. The Method in claim 23: wherein said drive means permits adjustment thru said drum to regulate the speed and synchronize same for both chucks.

26. The Method in claim 23: providing a means for engaging and disengaging said drive means.

* * * * *

UNITED STATES PATENT OFFICE

CERTIFICATE OF CORRECTION

Patent No. 4,004,529 Dated January 25, 1977

Inventor(s) Eugene R. Grotnes

It is certified that error appears in the above-identified patent and that said Letters Patent are hereby corrected as shown below:

Column 3, lines 4, 19 and 22, after "sleeve", each occurrence, insert -- M --; lines 5, 12 and 29, after "clutch", each occurrence, insert -- 27 --; lines 17, 18, 20 and 21, after "shaft", each occurrence, insert -- 26 --; lines 18, 24 and 36, " after "spring", each occurrence, insert -- G --.

Column 4, line 23, "cradles" should read -- cradled --; same line, after "cradle" insert -- and support assembly --; line 46, "42, 44" should read -- 34, 36 --; line 61, "112, 113" should read -- 113, 113' --; line 62, delete "and support means"

Column 5, line 11, "26" should read -- 28 --; line 68, "120" should read -- 140 --.

UNITED STATES PATENT OFFICE

CERTIFICATE OF CORRECTION

Patent No. 4,004,529 Dated January 25, 1977

Inventor(s) Eugene R. Grotnes

It is certified that error appears in the above-identified patent and that said Letters Patent are hereby corrected as shown below:

FIGURES 1, 3, 4, 6, 7 and 11, should appear as shown on the attached sheets.

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*